US011115753B2

(12) United States Patent
Yamashita

(10) Patent No.: US 11,115,753 B2
(45) Date of Patent: Sep. 7, 2021

(54) SOUND REPRODUCTION DEVICE AND SOUND REPRODUCTION SYSTEM

(71) Applicant: LAPIS SEMICONDUCTOR CO., LTD., Kanagawa (JP)

(72) Inventor: Takashi Yamashita, Kanagawa (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/936,528

(22) Filed: Jul. 23, 2020

(65) Prior Publication Data

US 2021/0029454 A1 Jan. 28, 2021

(30) Foreign Application Priority Data

Jul. 25, 2019 (JP) ..... JP2019-137213

(51) Int. Cl.
*H04R 5/04* (2006.01)
*H04R 3/12* (2006.01)

(52) U.S. Cl.
CPC ..... *H04R 5/04* (2013.01); *H04R 3/12* (2013.01); *H04R 2420/01* (2013.01); *H04R 2430/20* (2013.01)

(58) Field of Classification Search
None
See application file for complete search history.

(56) References Cited

U.S. PATENT DOCUMENTS

2019/0344805 A1* 11/2019 Sakata ..... B60N 2/90

FOREIGN PATENT DOCUMENTS

JP 2012085040 A 4/2012

OTHER PUBLICATIONS

English language translation of JP2012085040A, Apr. 2012. (Year: 2012).*

* cited by examiner

*Primary Examiner* — Paul W Huber
(74) *Attorney, Agent, or Firm* — Volentine, Whitt & Francos, PLLC

(57) ABSTRACT

A sound reproduction device including a sound reproduction control circuit that performs a required computation on audio source data so as to generate sound reproduction data to send to a speaker; a first communication interface circuit that performs communication with a control device; a counter circuit whose count operation is controlled by a control signal received from the control device through the first communication interface circuit, and that outputs a state of the count operation; and an error control circuit that stops generation of the sound reproduction data by the sound reproduction control circuit based on the state of the count operation.

9 Claims, 9 Drawing Sheets

RELATED ART

SOUND REPRODUCTION DEVICE AND SOUND REPRODUCTION SYSTEM

CROSS-REFERENCE TO RELATED APPLICATION

This application is based on and claims priority under 35 USC 119 from Japanese Patent Application No. 2019-137213 filed on Jul. 25, 2019, the disclosure of which is incorporated by reference herein.

BACKGROUND

Technical Field

The present disclosure relates to a sound reproduction device and a sound reproduction system, and in particular relates to a sound reproduction device and a sound reproduction system that give consideration to suppressing reproduction abnormalities when an abnormal device state has occurred.

Related Art

Japanese Patent Application Laid-Open (JP-A) No. 2012-85040 is an example of a known document relating to operation when an abnormal state occurs during sound reproduction. JP-A No. 2012-85040 discloses an onboard audio device including two amplification sections that amplify signals configuring a positive phase and a negative phase pair of an audio signal, and output the signals to a speaker. Also included is a power amplifier including an abnormality detection section that outputs an abnormality detection signal when a potential difference between the positive phase and the negative phase signals output by the two amplification sections exceeds a preset threshold. Also included is an audio level detection section that detects an audio level of an audio signal input to the power amplifier, and an audio level comparison section that compares the audio level detected by the audio level detection section against a preset audio level threshold. Also included is an abnormality determination section that stops operation of the power amplifier when the abnormality detection signal is output from the abnormality detection section in cases in which the audio level is the audio level threshold or less based on the comparison result of the audio level comparison section. The onboard audio device according to JP-A No. 2012-85040 enables the occurrence of a DC offset abnormality to be determined based on the abnormality detection signal during a period when the likelihood of false detection is low, even during audio output, thereby enabling the provision of an onboard audio device capable of determining an abnormality in a short determination duration.

The occurrence of abnormal noise from a speaker is an example of an undesirable consequence of an abnormal state of a sound reproduction system. Causes of abnormal noise occurring include connection abnormalities between a semiconductor device that performs sound reproduction (also referred to as an audio large scale integrated circuit (audio LSI)) and a speaker, and communication interface abnormalities between an audio LSI and a microcomputer (also referred to hereafter as a control microcomputer) that controls the audio LSI. In such cases, abnormal noise might be amplified by the speaker. "Abnormal noise" refers for example to unintentionally reproduced audio (reproduced audio is also referred to hereafter as a "phrase") and reproduced noise.

A method of suppressing the occurrence of abnormal noise by detecting connection abnormalities between the audio LSI and the speaker connected to the audio LSI is one known method used to address the issues described above.

However, when the above method of suppressing abnormal noise is applied, unintentional (inappropriate) orders might be issued, causing abnormal noise to occur as a result. JP-A No. 2012-85040 aims to shorten the abnormality determination duration in the onboard audio device, but gives no consideration to the issue described above.

SUMMARY

An aspect of the present disclosure is a sound reproduction device that includes: a sound reproduction control circuit configured to perform a required computation on audio source data so as to generate sound reproduction data to send to a speaker; a first communication interface circuit configured to perform communication with a control device; a counter circuit whose count operation is controlled by a control signal received from the control device through the first communication interface circuit, and configured to output a state of the count operation; and an error control circuit configured to stop generation of the sound reproduction data by the sound reproduction control circuit based on the state of the count operation.

DETAILED DESCRIPTION

A method of suppressing the occurrence of abnormal noise by detecting connection abnormalities between an audio LSI and a speaker connected to the audio LSI is known. Explanation follows regarding this method, with reference to an audio LSI 100 according to a comparative example, illustrated in FIG. 6.

Figure 6:
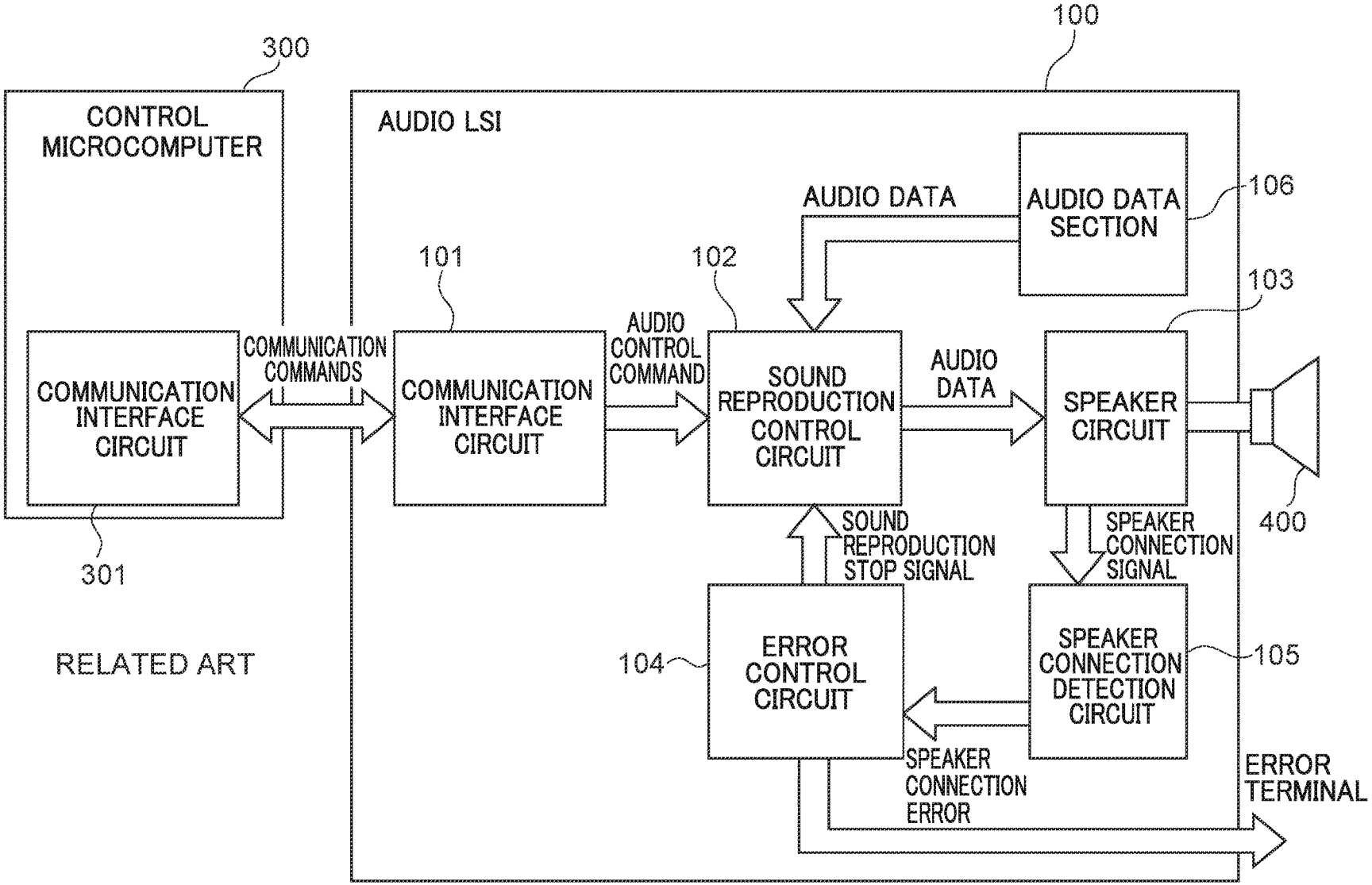
FIG. 6 is a block diagram illustrating an example of configuration of a sound reproduction device according to a comparative example.

As illustrated in FIG. 6, in the audio LSI 100, a sound reproduction control circuit 102 receives audio data from an audio data section 106 that holds audio data configuring the basis of a phrase. After performing a prescribed computation, the sound reproduction control circuit 102 sends the audio data that has been subjected to this computation to a speaker circuit 103 serving as a speaker drive circuit. The speaker circuit 103 drives a speaker 400 in order to reproduce sound. The audio LSI 100 is connected to a control microcomputer 300 through communication interface circuits 101, 301. The sound is reproduced according to control based on commands from the control microcomputer 300 transmitted via these communication interfaces.

The audio LSI 100 also includes a speaker connection detection circuit 105 and an error control circuit 104. In cases in which a connection abnormality has occurred according to a speaker connection signal indicating a speaker connection state sent from the speaker circuit 103, the speaker connection detection circuit 105 sends a signal indicating a speaker connection error to the error control circuit 104. On receiving the speaker connection error signal, the error control circuit 104 controls the sound reproduction control circuit 102 so as to stop sound reproduction.

However, there is a concern that the following situation might arise in the audio LSI 100 according to the comparative example. Namely, sound reproduction might be stopped immediately even in cases in which a connection abnormality between the audio LSI 100 and the speaker 400 has been falsely detected. Moreover, the audio LSI 100 might be unable to detect an abnormality in cases in which a communication interface between the audio LSI 100 and the control microcomputer 300 is not operating normally, with the result that the control microcomputer 300 might issue unintentional (inappropriate) orders to the audio LSI 100, causing abnormal noise to occur.

Detailed explanation follows regarding exemplary embodiments of the present disclosure, with reference to the drawings. In the following explanation, explanation is given regarding examples of embodiments applied to a sound reproduction device and a sound reproduction system according the present disclosure, in which the sound reproduction device and the sound reproduction system coordinate with a control microcomputer to detect device abnormalities during sound reproduction, and thereby suppress the occurrence of abnormal noise accompanying such abnormalities.

First Exemplary Embodiment

Figure 1:
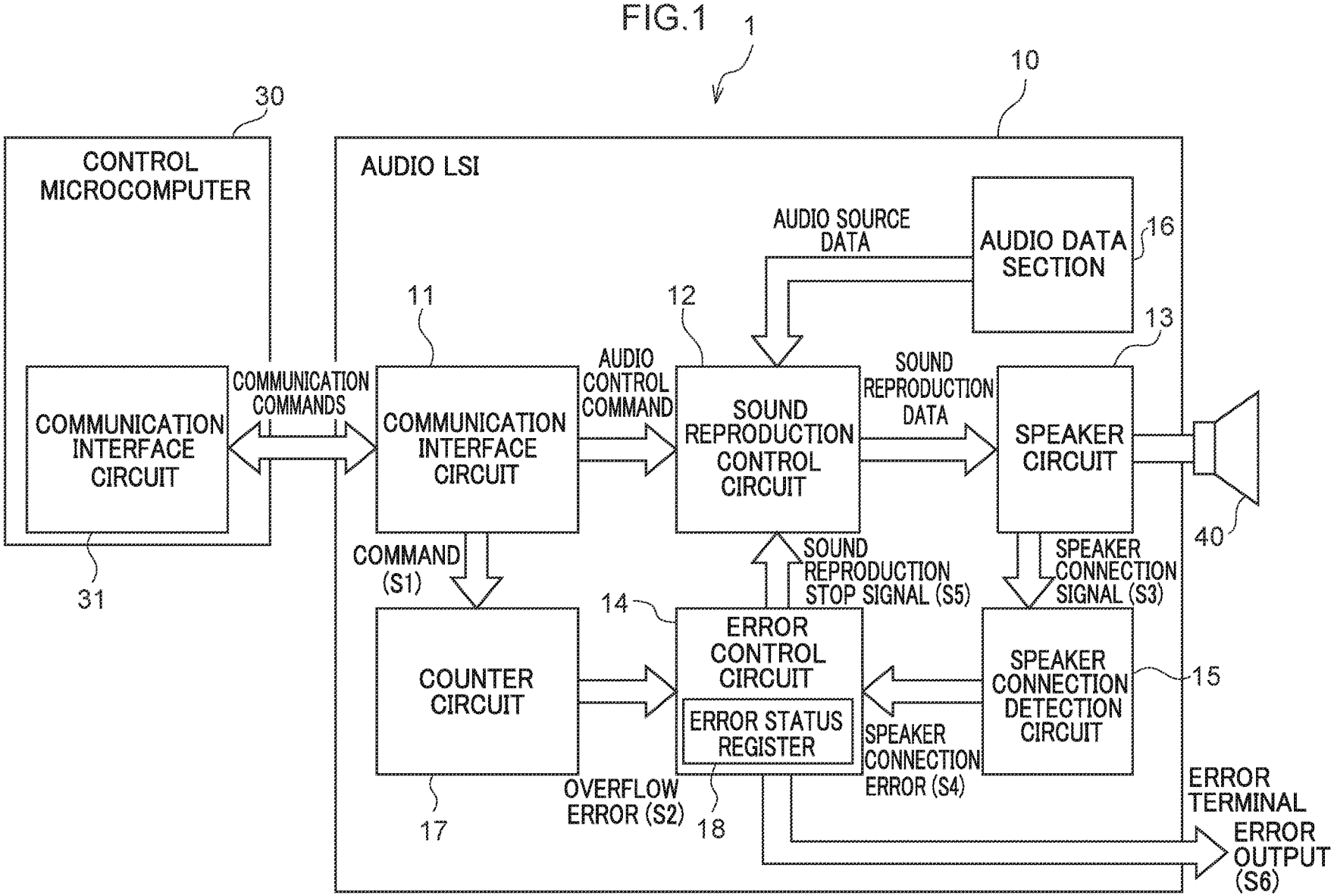
FIG. 1 is a block diagram illustrating an example of configuration of a sound reproduction device and a sound reproduction system according to a first exemplary embodiment.
Figure 2A:
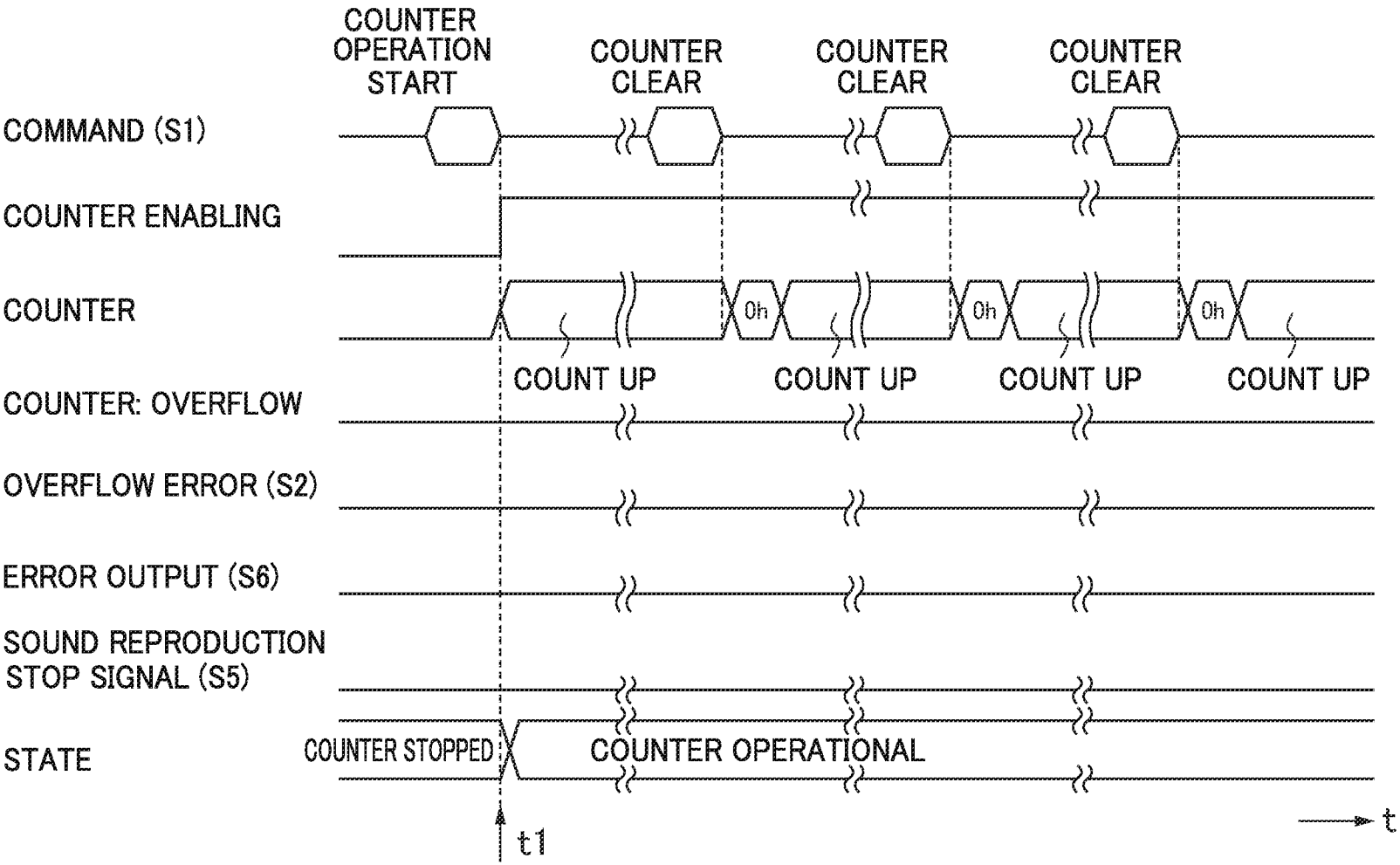
FIG. 2A is a timing chart to explain normal operation of a sound reproduction device according to the first exemplary embodiment.
Figure 2B:
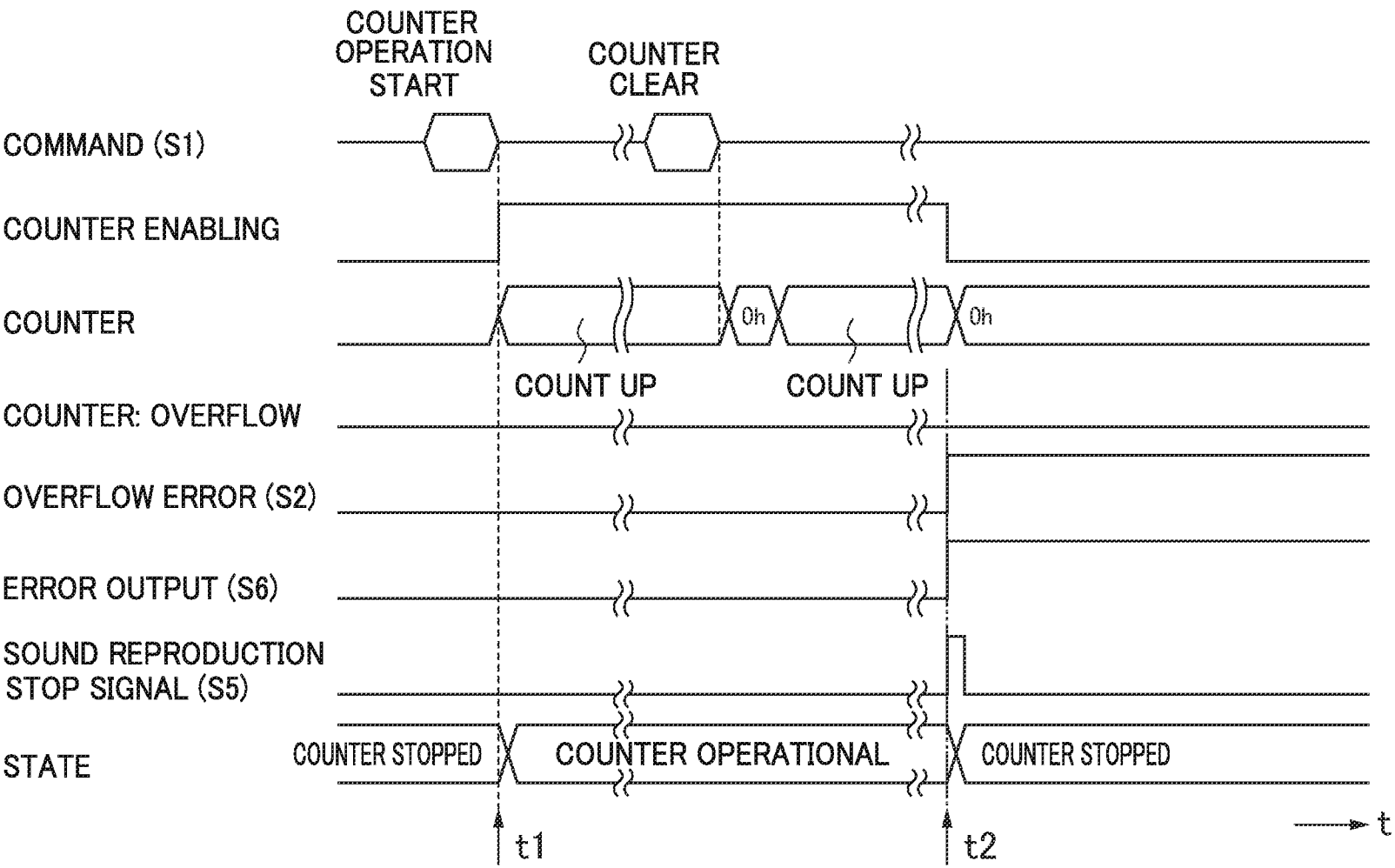
FIG. 2B is a timing chart to explain operation of a sound reproduction device according to the first exemplary embodiment when an abnormality has been detected.

Explanation follows regarding a sound reproduction device and a sound reproduction system according to a first exemplary embodiment, with reference to FIG. 1 to FIG. 2B. The sound reproduction system according to the present exemplary embodiment is for example employed to provide audio guidance for various equipment. The sound reproduction device and the sound reproduction system according to the present exemplary embodiment are provided with countermeasures against cases in which an abnormality occurs in a communication interface with a control microcomputer. Although the sound reproduction device and the sound reproduction system according to the present exemplary embodiment also include configuration to detect speaker connection abnormalities and stop sound reproduction, the detection of communication interface abnormalities according to the present exemplary embodiment is performed by operation that is independent to the detection of speaker abnormalities.

As illustrated in FIG. 1, a sound reproduction system 1 is configured including an audio LSI 10, a control microcomputer 30, and a speaker 40. The audio LSI 10 is an example of a sound reproduction device according to the present disclosure. The control microcomputer 30 transmits control signals and so on required for sound reproduction to the audio LSI 10, and receives signals and so on indicating the state of the audio LSI 10 from the audio LSI 10. The control microcomputer 30 therefore includes a communication interface circuit 31 for communicating with the audio LSI 10. The speaker 40 amplifies sound based on a drive signal from the audio LSI 10. Note that the control microcomputer 30 is an example of a control device according to the present disclosure.

As illustrated in FIG. 1, the audio LSI 10 is configured including a communication interface circuit 11, a sound reproduction control circuit 12, a speaker circuit 13, an error control circuit 14, a speaker connection detection circuit 15, a counter circuit 17, and an audio data section 16. The communication interface circuit 11, the sound reproduction control circuit 12, the speaker circuit 13, the error control circuit 14, the speaker connection detection circuit 15, and the audio data section 16 illustrated in FIG. 1 have similar respective functionality to the communication interface circuit 101, the sound reproduction control circuit 102, the speaker circuit 103, the error control circuit 104, the speaker connection detection circuit 105, and the audio data section 106 illustrated in FIG. 6. Note that the speaker circuit 13 and the speaker connection detection circuit 15 are respectively examples of a monitoring circuit and a detection circuit according to the present disclosure.

The communication interface circuit 11 is connected to the communication interface circuit 31 provided to the control microcomputer 30, and serves as a circuit employed in the two-way exchange of various signals (labeled "communication commands" in FIG. 1) with the control microcomputer 30.

The audio data section 16 holds audio data that forms the basis of phrase generation (hereafter also referred to as audio source data).

The sound reproduction control circuit 12 reads required audio source data from the audio data section 16 based on a control signal (labeled "audio control command" in FIG. 1) received through the communication interface circuit 11, and performs predetermined computation on the read audio source data so as to generate audio data (hereafter also referred to as sound reproduction data) capable of being reproduced by the speaker circuit 13. In the present exemplary embodiment, the audio source data is for example audio data in which a phrase has been compressed, and the predetermined computation is for example to expand the compressed audio data and convert to a signal corresponding to an original phrase.

The speaker circuit 13 drives the speaker 40 based on the sound reproduction data so as to amplify sound of the phrase. The speaker circuit 13 includes an inbuilt circuit to monitor the connection with the speaker 40, and sends a monitoring result to the speaker connection detection circuit 15 as a speaker connection signal S3.

The speaker connection detection circuit 15 determines a connection state of the speaker 40 based on the speaker connection signal S3 sent from the speaker circuit 13, and sends a speaker connection error S4 to the error control circuit 14 in cases in which an abnormality has been determined to be present.

The error control circuit 14 stores a signal corresponding to the speaker connection error S4 sent from the speaker connection detection circuit 15 against the relevant register in an error status register 18. Note that the error status register 18 is a register that also stores various other states of the audio LSI 10 (such as a temperature error in the audio LSI 10) in addition to the speaker connection error S4, and all signals specifying operation of the error control circuit 14 are temporarily held in the error status register 18.

On receiving the speaker connection error S4 from the speaker connection detection circuit 15, the error control circuit 14 sends a sound reproduction stop signal S5 to the sound reproduction control circuit 12 in order to stop sound reproduction processing by the sound reproduction control circuit 12. On receiving the sound reproduction stop signal S5, the sound reproduction control circuit 12 stops sound reproduction, resulting in a state in which no sound reproduction data is sent to the speaker 40. The error control circuit 14 also outputs an error output S6 through an error terminal when an abnormality has been detected.

The configuration described above is a similar configuration to that of the audio LSI 100 according to the comparative example illustrated in FIG. 6. Thus, similarly to the audio LSI 100, the audio LSI 10 includes functionality to stop sound reproduction on detection of a speaker connection abnormality. However, the present exemplary embodiment explains operation performed independently of (unrelated to) a speaker connection abnormality detection section.

The audio LSI 10 according to the present exemplary embodiment is further configured including the counter circuit 17. Operation of the counter circuit 17 is controlled by a command S1 transmitted through the communication interface circuits 31, 11. Namely, a count operation (tally operation) starts in response to a counter operation start command from the control microcomputer 30, and the count operation stops in response to a counter clear command (see FIG. 2). In cases in which the counter clear command is not received by audio LSI 10 for whatever reason, the counter circuit 17 overflows, and an overflow error S2 is sent to the error control circuit 14 when this occurs.

Next, detailed explanation follows regarding operation of the audio LSI 10, with reference to FIG. 2A and FIG. 2B. As described above, the present exemplary embodiment envisages an abnormality in a communication interface with the control microcomputer 30 as an abnormality affecting the audio LSI 10. In the present exemplary embodiment, communication interface abnormalities include abnormalities such as short circuits or broken (open) circuits in the communication interface circuit 31 or 11, and abnormalities such as short circuits or broken (open) circuits on a communication path between the communication interface circuit 31 and the communication interface circuit 11.

FIG. 2A and FIG. 2B illustrate waveforms in each section of the audio LSI 10 that change according to the operation of the audio LSI 10. FIG. 2A is a timing chart illustrating a case in which the audio LSI 10 is operating normally, and FIG. 2B is a timing chart illustrating a case in which a communication interface abnormality has occurred. FIG. 2A and FIG. 2B illustrate the respective waveforms of the command S1, the overflow error S2, the error output S6, and the sound reproduction stop signal S5. In addition to these signals, FIG. 2A and FIG. 2B also illustrate a counter enabling signal waveform (labeled as "counter enabling" in FIG. 2A and FIG. 2B), a counter operation waveform (labeled as "counter" in FIG. 2A and FIG. 2B), a signal indicating counter overflow (labeled as "counter: overflow" in FIG. 2A and FIG. 2B), and a waveform indicating a counter state (labeled as "state" in FIG. 2A and FIG. 2B). Note that the respective labels counter enabling, counter, counter: overflow, and state each indicate an internal signal within the counter circuit 17, or an internal state of the counter circuit 17.

As illustrated in FIG. 2A, in cases in which the audio LSI 10 is operating normally, the control microcomputer 30 issues the counter operation start command to the audio LSI 10, after which the control microcomputer 30 periodically issues the counter clear command. On receiving the counter operation start command, the counter circuit 17 transitions the counter enabling signal from low level (hereafter referred to as L) to high level (hereafter referred to as H) (at timing t1), and starts the count (counts up) from the timing t1 as indicated by the counter waveform and the state waveform.

Then, when the counter clear command is issued in the audio LSI 10, the counter circuit 17 clears the counter so as to set the count value to 0h, as indicated by the counter waveform. The counter clear command issue timing is set such that the command is issued before the counter circuit 17 overflows, such that the counter circuit 17 does not overflow. The counter overflow, the overflow error S2, and the error output S6 waveforms thus remain at L. The sound reproduction stop signal S5 is also maintained at L, such that the sound reproduction control circuit 12 continues to generate sound reproduction data. Namely, in the present exemplary embodiment, as long as the counter circuit 17 does not overflow, determination is made that an abnormality has not occurred in the audio LSI 10. Note that although the present exemplary embodiment describes an example in which the control microcomputer 30 issues the counter clear command periodically, there is no limitation thereto. As long as the requirement that the counter circuit 17 does not overflow is satisfied, the counter clear command does not have to be issued periodically.

However, the counter clear commands do not reach the counter circuit 17 in cases in which a communication interface abnormality occurs after the counter operation start command has been issued. FIG. 2B is a timing chart illustrating a case in which a communication interface abnormality occurs after the counter operation start command and a number of counter clear commands have been issued.

As illustrated in FIG. 2B, the count operation starts at the timing t1, but overflow then occurs at a timing t2 due to the counter clear command not having been received. When this occurs, a signal indicating the overflow is generated for the counter: overflow, the overflow error S2 and the error output S6 transition from L to H, and the state changes from a counter operational state to a counter stopped state. On receiving the overflow error S2, the error control circuit 14 sends the sound reproduction stop signal S5 to the sound reproduction control circuit 12. On receiving the sound reproduction stop signal S5, the sound reproduction control circuit 12 stops sound reproduction.

Note that although the present exemplary embodiment describes an example in which sound reproduction is stopped in cases in which an abnormality has occurred in the audio LSI 10, there is no limitation thereto. Configuration may be made such that without stopping reproduction, or in addition to stopping reproduction, the speaker 40 amplifies the sound of a phrase informing that an abnormality has occurred (a phrase such as "An abnormality has occurred").

As described in detail above, the sound reproduction device and the sound reproduction system according to the present exemplary embodiment enable the provision of a sound reproduction device and a sound reproduction system that are capable of suppressing the occurrence of abnormal noise. In particular, the sound reproduction device and the sound reproduction system according to the present exemplary embodiment suppress the occurrence of abnormal noise in cases in which an abnormality has occurred at a communication interface with the control microcomputer.

Second Exemplary Embodiment

Figure 3:
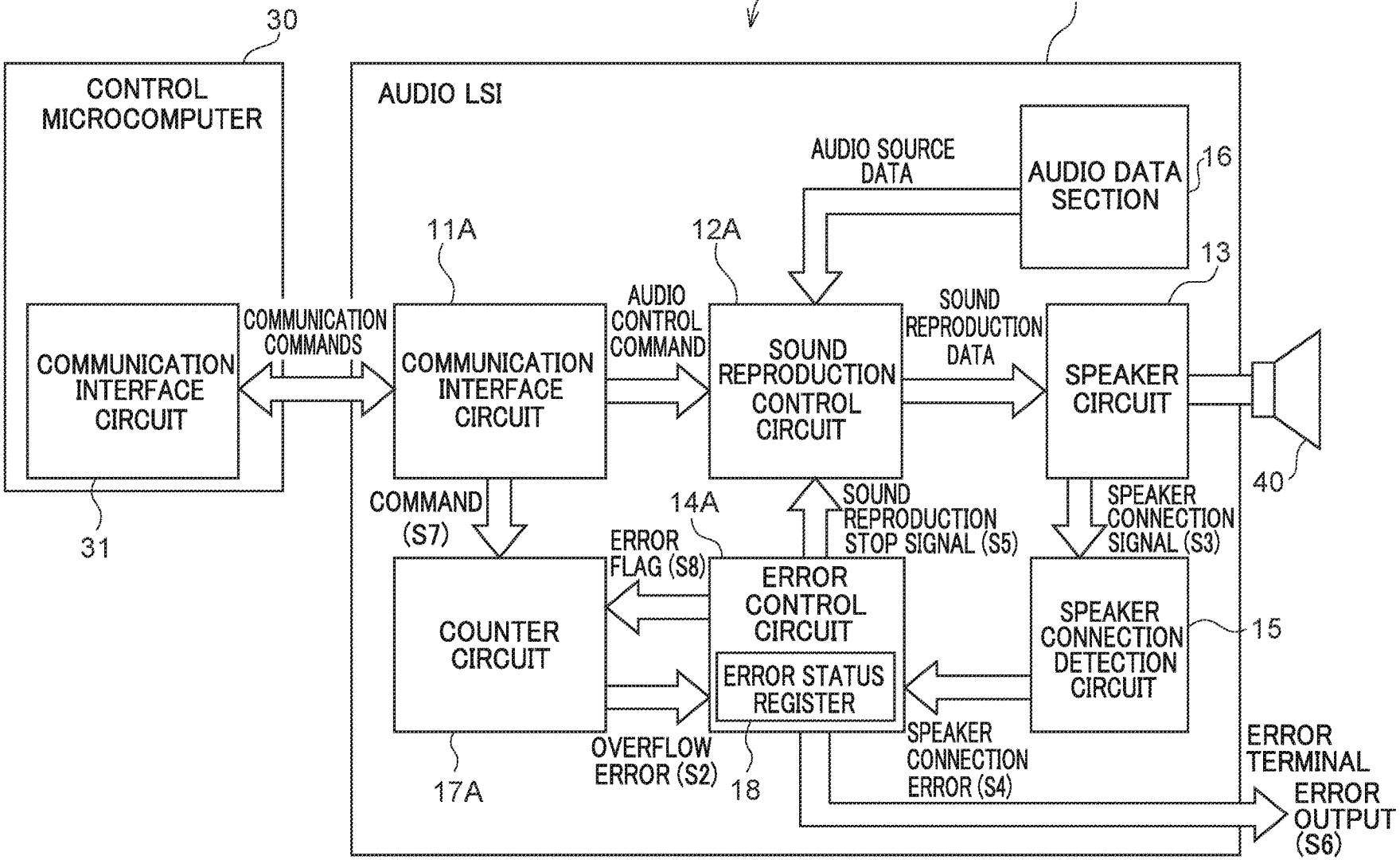
FIG. 3 is a block diagram illustrating an example of configuration of a sound reproduction device and a sound reproduction system according to a second exemplary embodiment.
Figure 4A:
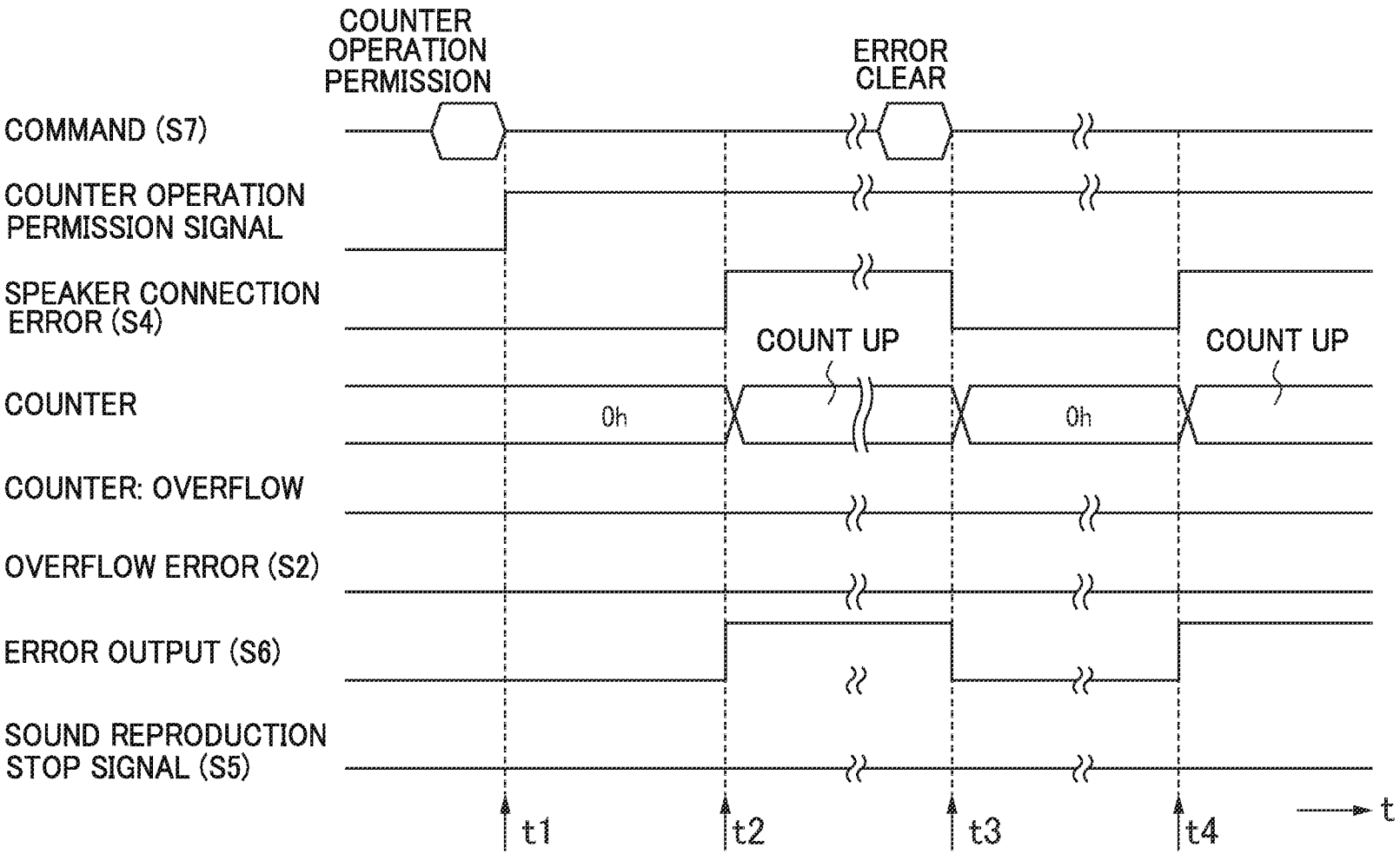
FIG. 4A is a timing chart to explain operation of a sound reproduction device according to the second exemplary embodiment in a case in which abnormality detection is a result of false detection.
Figure 4B:
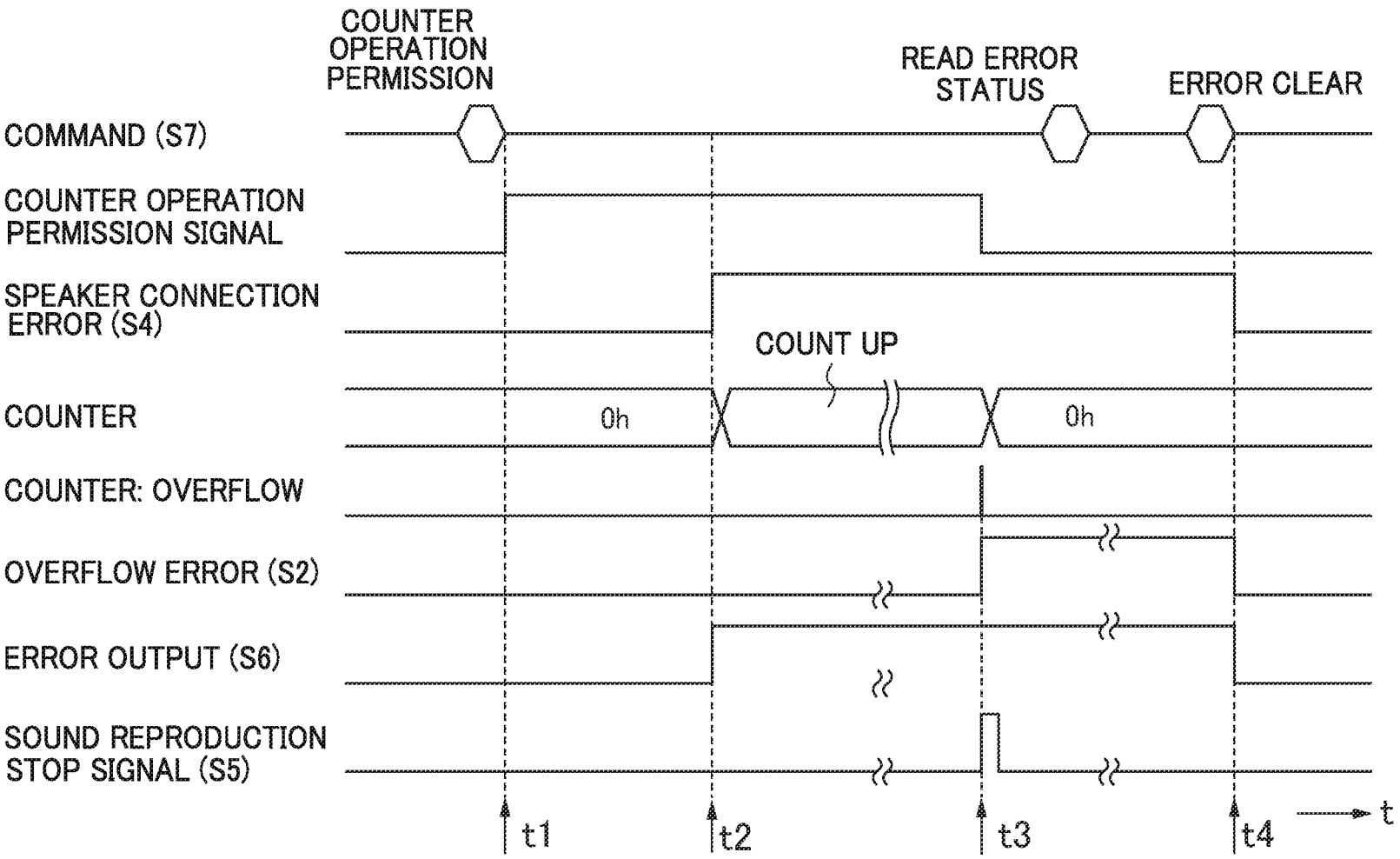
FIG. 4B is a timing chart to explain operation of a sound reproduction device according to the second exemplary embodiment in a case in which abnormality detection is not a result of false detection.

Explanation follows regarding an audio LSI 10A and a sound reproduction system 1A according to a second exemplary embodiment, with reference to FIG. 3 to FIG. 4B. In the present exemplary embodiment, in cases in which a speaker connection abnormality has been detected, determination is made as to whether or not this abnormality detection is a result of false detection, and sound reproduction is not stopped (sound reproduction is continued) in cases in which false detection is determined to have occurred.

As illustrated in FIG. 3, the sound reproduction system 1A differs from the sound reproduction system 1 according to the first exemplary embodiment in the respect that the audio LSI 10A is provided instead of the audio LSI 10. The audio LSI 10A differs from the audio LSI 10 in the respect that the communication interface circuit has been renumbered from 11 to 11A, the sound reproduction control circuit has been renumbered from 12 to 12A, the counter circuit has been renumbered from 17 to 17A, and the error control circuit has been renumbered from 14 to 14A. Since other configuration is similar to that of the audio LSI 10, such similar configuration is allocated the same reference numerals and detailed explanation thereof is omitted.

In the present exemplary embodiment, the control microcomputer 30 transmits a command S7 including a counter operation permission command and an error clear command subsequent to the counter operation permission command to the counter circuit 17A through the communication interface circuits 31, 11A (see FIG. 4A and FIG. 4B). In the present exemplary embodiment, operation to detect a speaker connection abnormality and stop sound reproduction is also executed by the speaker circuit 13, the speaker connection detection circuit 15, the error control circuit 14A, and the sound reproduction control circuit 12A.

Next, explanation follows regarding operation of the audio LSI 10A and the sound reproduction system 1A, with reference to FIG. 4A and FIG. 4B. FIG. 4A illustrates a timing chart in a case in which a detected speaker connection abnormality is a result of false detection, and FIG. 4B illustrates a timing chart in a case in which a detected speaker connection abnormality is not a result of false detection. The timing charts illustrated in FIG. 4 differ from the timing charts illustrated in FIG. 2 in the respect that the counter operation start command and the counter clear commands have been changed to the counter operation permission command and the error clear commands, the counter enabling signal has been replaced with a counter operation permission signal, and a speaker connection error S4 has been added.

As illustrated in FIG. 4A, when the control microcomputer 30 transmits the counter operation permission command to the counter circuit 17A through the communication interface circuits 31, 11A, the counter circuit 17A generates the counter operation permission signal (at timing t1). The counter operation permission signal in FIG. 4A has a function corresponding to that of the counter enabling signal in FIG. 2A and FIG. 2B. In FIG. 4A, a speaker connection abnormality has not been detected at the point in time when the counter operation permission signal is generated, and so the speaker connection error S4 is at L. The error output S6 output in accordance with the speaker connection error S4 is similarly at L. Thus, the counter circuit 17A is not operational.

In FIG. 4A, the speaker connection error S4 transitions from L to H at timing t2. This is due to the speaker connection detection circuit 15 having determined that a speaker connection abnormality has occurred based on the speaker connection signal S3 from the speaker circuit 13, and having sent the speaker connection error S4 to the error status register 18 of the error control circuit 14A. Note that the error output S6 in FIG. 4A behaves in a similar manner to the speaker connection error S4.

On receiving the speaker connection error S4 through the control microcomputer 30, the counter circuit 17A starts the count (tally) (counts up). Subsequent to the counter operation permission command, the error clear command is transmitted from the control microcomputer 30 to the counter circuit 17A. In cases in which the counter circuit 17A receives the error clear command before overflowing, the counter circuit 17A is cleared, reset to 0h, and the count operation is stopped (at timing t3). The above operation is executed when the control microcomputer 30 determines that the detected speaker connection abnormality is a result of false detection, and the error clear command is transmitted to the counter circuit 17A prior to the counter circuit 17A overflowing. Regarding determination as to whether or not a detected abnormality is a result of false detection, for example, false detection may be determined to have occurred in cases in which a continuation duration of the abnormality detection signal is shorter than a predetermined period. The sound reproduction stop signal S5 is not sent from the error control circuit 14A to the sound reproduction control circuit 12A until the predetermined period has elapsed. Counting by the counter circuit 17A then restarts when the speaker connection error S4 returns to H (at timing t4).

As described above, in the sound reproduction system 1A, in cases in which the detected connection abnormality of the speaker 40 is determined to be a result of false detection, the generation of sound reproduction data by the sound reproduction control circuit 12A is continued without being stopped. Thus, the sound reproduction system 1A suppresses excessive sound reproduction stoppages resulting from the false detection of abnormalities.

Next, explanation follows with reference to FIG. 4B, which illustrates similar operation to that in FIG. 4A as far as the timing t2. The fact that at the timing t2, the speaker connection error S4 transitions from L to H, a speaker connection abnormality is detected, and the counter circuit 17A starts counting is also similar to FIG. 4A. However, in the case of FIG. 4B, the control microcomputer 30 does not issue the error clear command at least until the counter circuit 17A overflows. This operation executed as a result of the control microcomputer 30 having determined that the detected speaker connection abnormality is not a result of false detection, and intentionally causing the counter circuit 17A to overflow. Note that the control microcomputer 30 may freely control the duration from the point in time when an abnormality is detected until the error clear command is issued.

When the counter circuit 17A overflows at the timing t3, the overflow error S2 transitions from L to H, the error control circuit 14A issues the sound reproduction stop signal S5 in response to this transition, and sound reproduction by the sound reproduction control circuit 12A is stopped. Moreover, the control microcomputer 30 issues an error status read command, and reads the content of the error held in the error status register 18. The control microcomputer 30 then transmits the error clear command to the counter circuit 17A at the timing t4, and the speaker connection error S4, the error output S6, and the overflow error S2 transition from H to L accompanying this. The above operation suppresses the speaker 40 from amplifying the sound of an abnormal noise in cases in which the detected speaker connection abnormality is determined not to be the result of false detection.

Figure 5:
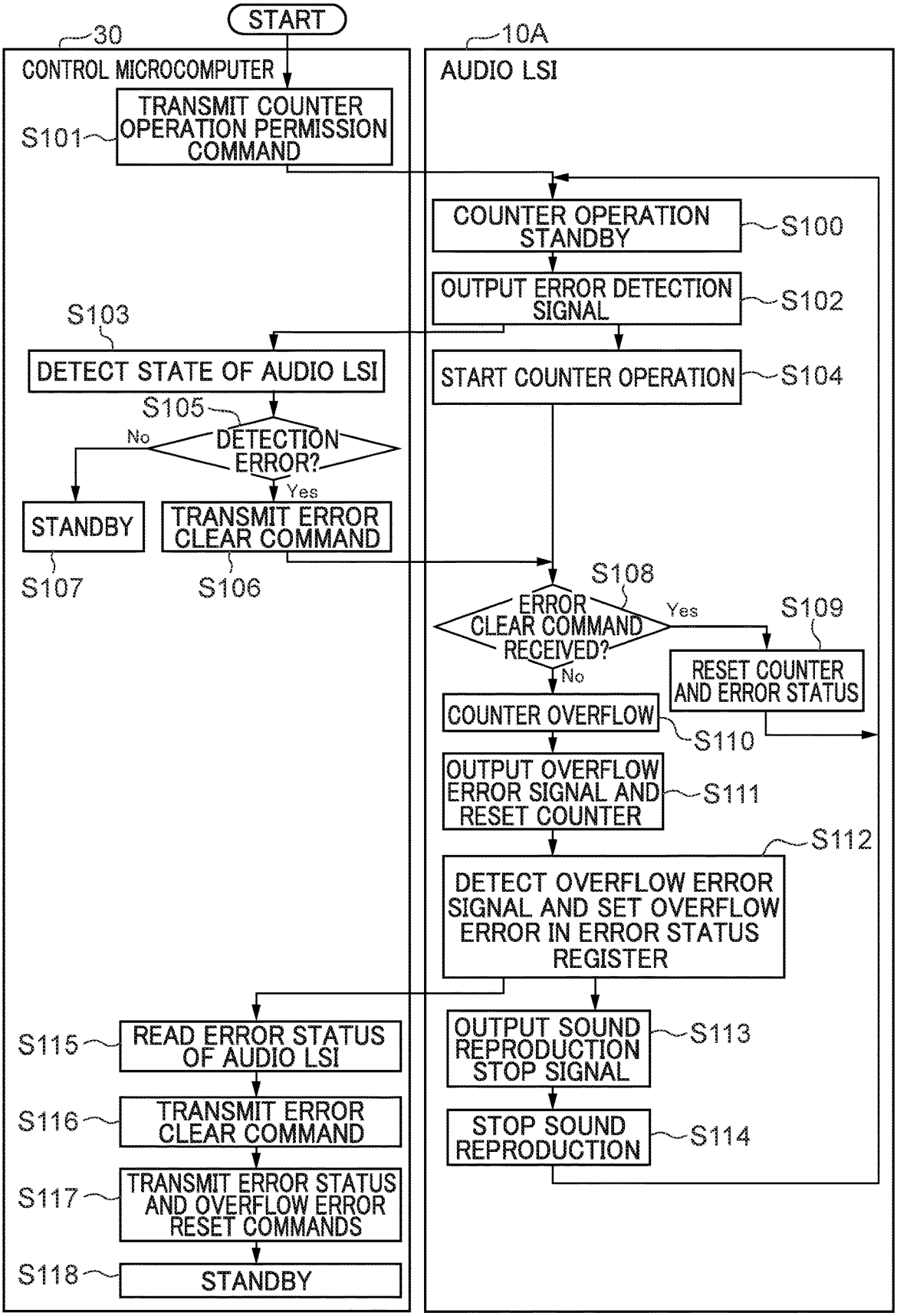
FIG. 5 is a flowchart illustrating an example of a flow of sound reproduction processing of a sound reproduction system according to the second exemplary embodiment.

Next, explanation follows regarding a sound reproduction processing program executed by the audio LSI 10A and the sound reproduction system 1A according to the present exemplary embodiment, with reference to FIG. 5. FIG. 5 is a flowchart illustrating an example of a flow of the sound reproduction processing program. The sound reproduction processing program is for example started by turning on a power source of equipment installed with the audio LSI 10A.

First, at step S100, the audio LSI 10A adopts a counter operation standby state, namely, resets the counter circuit 17A, so as to be in in a state awaiting input.

At step S101, the control microcomputer 30 transmits the counter operation permission command (at the timing t1 in FIG. 4A and FIG. 4B).

At step S102, the audio LSI 10A outputs an error detection signal. In the present exemplary embodiment, the speaker connection detection circuit 15 sends the speaker connection error S4 to the error status register 18.

At step S103, the control microcomputer 30 detects the state of the audio LSI 10A. Namely, the control microcomputer 30 reads the error status register 18 via the communication interface circuits 31, 11A (operation corresponding to this step is omitted from illustration in FIG. 4A and FIG. 4B). Specifically, as illustrated in FIG. 3, an error flag S8 is read. To allow a more intuitive understanding, FIG. 3 illustrates the error flag S8 as being output to the counter circuit 17A; in practice, however, intermediate processing is performed by the control microcomputer 30.

At step S104, the counter circuit 17A starts the counter operation. Namely, on receiving a connection abnormality of the speaker 40, the control microcomputer 30 transmits an operation start signal to the counter circuit 17A via the communication interface circuits 31, 11A (this operation is omitted from illustration in FIG. 4A and FIG. 4B), and the counter circuit 17A thereby starts the operation (at the timing t2 in FIG. 4A and FIG. 4B).

At step S105, the control microcomputer 30 determines whether or not the detected connection error of the speaker 40 is a result of false detection. In cases in which negative determination is made (i.e. the detection is not false) at this determination, processing transitions to step S107 and a standby state is adopted (from the timing t2 in FIG. 4B onward). Namely, no processing is executed as time passes in standby. In cases in which affirmative determination is made at step S105 (i.e. the detection is false), at step S106, the control microcomputer 30 transmits the error clear command (at the timing t3 in FIG. 4B).

At step S108, determination is made as to whether or not the counter circuit 17A has received the error clear command. Namely, after the counter circuit 17A starts operation at the timing t2 in FIG. 4A and FIG. 4B, the counter circuit 17A stands by for receipt of the error clear command. In cases in which an affirmative determination is made (at the timing t3 in FIG. 4A), at step S109, the counter circuit 17A and the error status are reset. Namely, the error control circuit 14A initializes the corresponding register in the error status register 18. In cases in which negative determination is made, processing transitions to step S110, and the counter operation is placed in a standby state.

At step S110, the counter circuit 17A overflows as a result of the counter circuit 17A not having received the error clear command (at the timing t3 in FIG. 4B).

At step S111, the counter circuit 17A outputs the overflow error signal (overflow error S2) and resets the counter (at the timing t3 in FIG. 4B).

At step S112, the error control circuit 14A detects the overflow error signal and sets an overflow error in the error status register 18.

At step S113, the error control circuit 14A outputs the sound reproduction stop signal S5 (at the timing t3 in FIG. 4B). At step S114, the sound reproduction control circuit 12A stops sound reproduction. Processing then transitions to step S100, and the counter operation is placed in a standby state.

At step S115, the control microcomputer 30 issues an error status command (corresponding to "read error status" in FIG. 4B), and reads the error status from the error status register 18 of the audio LSI 10A.

At step S116, the control microcomputer 30 transmits the error clear command to the audio LSI 10A (at the timing t4 in FIG. 4B). At step S117, the control microcomputer 30 resets the error status and the overflow error. Namely, commands corresponding to this operation are transmitted to the audio LSI 10A, and the error status register 18 is initialized. At step S118, a standby state is adopted.

The sound reproduction processing program is ended by for example switching off the power source of the equipment installed with the audio LSI 10A.

As described in detail above, in the audio LSI 10A and the sound reproduction system 1A according to the present exemplary embodiment, the control microcomputer 30 is able to freely set the duration from the point in time when an abnormality is detected until the error clear command is issued. Thus, for example, in cases in which the occurrence of a connection abnormality between the audio LSI 10A and the speaker 40 has been detected, the control microcomputer 30 is able to perform control such that the overflow error is detected after a fixed deferment period has been secured, and sound reproduction is stopped in cases in which the detected connection abnormality is genuine. This suppresses excessive restriction of sound reproduction, as might arise in cases in which a connection abnormality detection is a result of false detection.

Although the above exemplary embodiments have described examples in which a connection abnormality between the audio LSI and the speaker serves as a trigger for starting the counter operation, there is no limitation thereto. For example, another internal error of the audio LSI, or a connection abnormality with another externally connected component, may serve as a trigger for starting the counter operation.

Figure 7:
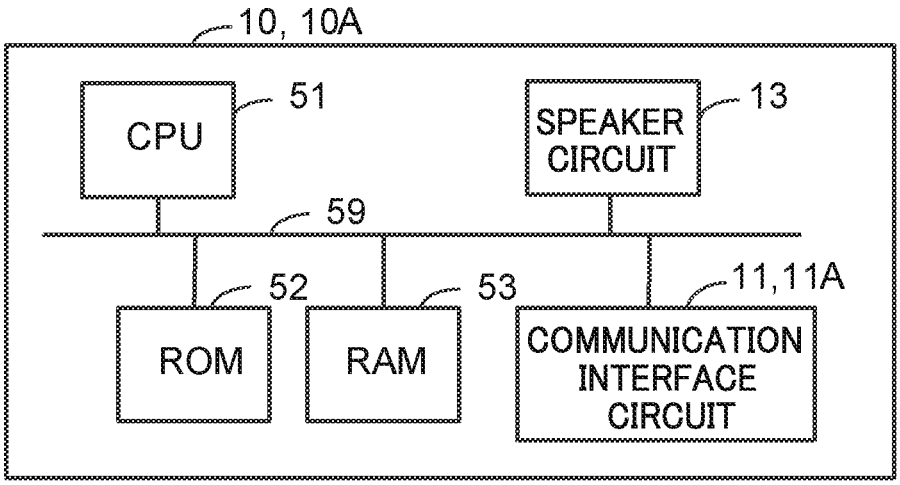
FIG. 7 is a diagram illustrating an example of a hardware configuration of an audio LSI.

FIG. 7 is a diagram illustrating an example of hardware configuration of the audio LSIs 10, 10A of the above exemplary embodiments. Each of the audio LSIs 10, 10A includes a CPU 51 serving as an example of a hardware processor, ROM 52, RAM 53, the communication interface circuit 11 or 11A, and the speaker circuit 13. The CPU 51, the ROM 52, the RAM 53, the communication interface circuit 11 or 11A, and the speaker circuit 13 are connected to one another through a bus 59.

The sound reproduction processing program is stored in the ROM 52. The CPU 51 loads and executes the sound reproduction processing program in order to operate as the sound reproduction control circuit 12, 12A, the speaker connection detection circuit 15, the error control circuit 14 or 14A, and the counter circuit 17 or 17A. The RAM 53 functions as the audio data section 16 and the error status register 18. The audio data section 16 may be configured by separate RAM to the error status register 18.

Note that at least one out of the sound reproduction control circuit 12 or 12A, the speaker connection detection circuit 15, the error control circuit 14 or 14A, or the counter circuit 17 or 17A may be configured by wired logic.

Figure 8:
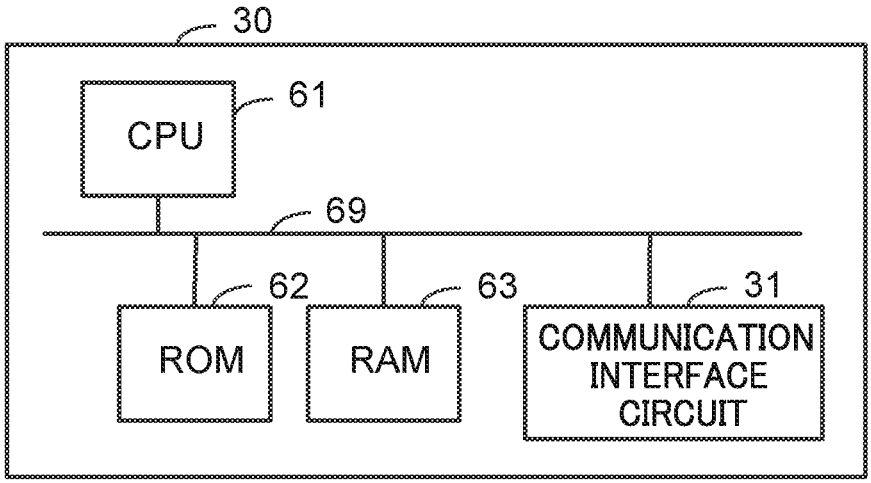
FIG. 8 is a diagram illustrating an example of a hardware configuration of a control microcomputer.

FIG. 8 is a diagram illustrating an example of hardware configuration of the control microcomputer 30 of the respective exemplary embodiments. The control microcomputer 30 includes a CPU 61 serving as an example of a hardware processor, ROM 62, RAM 63, and the communication interface circuit 31. The CPU 61, the ROM 62, the RAM 63, and the communication interface circuit 31 are connected to one another through a bus 69.

A sound reproduction control program is stored in the ROM 62. The CPU 61 loads and executes the sound reproduction control program to operate as the control microcomputer 30.

Communication between the control microcomputer 30 and the audio LSI 10, 10A may be performed by wired communication or by wireless communication. The connection between the speaker 40 and the audio LSI 10, 10A may be a wired connection or a wireless connection.

An object of the present disclosure is to provide a sound reproduction device and a sound reproduction system capable of suppressing the occurrence of abnormal noise.

A sound reproduction system of the present disclosure includes a sound reproduction device, and a control device including a second communication interface section that performs communication with a first communication interface section.

The present disclosure enables the provision of a sound reproduction device and a sound reproduction system capable of suppressing the occurrence of abnormal noise.

What is claimed is:

1. A sound reproduction device comprising:

a sound reproduction control circuit configured to perform a required computation on audio source data so as to generate sound reproduction data to send to a speaker;

a first communication interface circuit configured to perform communication with a control device;

a counter circuit whose count operation is controlled by a control signal received from the control device through the first communication interface circuit, and configured to output a state of the count operation; and an error control circuit configured to stop generation of the sound reproduction data by the sound reproduction control circuit based on the state of the count operation, wherein the control signal includes a start signal for starting the count operation, and a reset signal for resetting the count operation subsequent to the start signal, and in cases in which the state of the count operation is an overflow occurring as a result of the reset signal not having been received by the counter circuit, the error control circuit stops the generation of the sound reproduction data by the sound reproduction control circuit.

2. The sound reproduction device of claim 1, wherein the control device includes a second communication interface circuit configured to perform communication with the first communication interface circuit, and the overflow occurs in cases in which the counter circuit is unable to receive the reset signal due to a communication abnormality between the first communication interface circuit and the second communication interface circuit.

3. The sound reproduction device of claim 1, further comprising:

a monitoring circuit disposed between the sound reproduction control circuit and the speaker, and configured to output a state signal indicating a connection state of the speaker; and a detection circuit configured to detect the connection state of the speaker based on the state signal, wherein the error control circuit controls the counter circuit so as to start the count operation in cases in which an abnormal connection state has been detected by the detection circuit, and the control device sends an error clear signal to the counter circuit to stop the count operation in cases in which determination is made that the abnormal connection state detected by the detection circuit is a result of false detection.

4. The sound reproduction device of claim 3, wherein the control device determines that the abnormal connection state is the result of false detection in cases in which a period during which the abnormal connection state is detected by the detection circuit is shorter than a predetermined period.

5. The sound reproduction device of claim 3, wherein the error control circuit stops the generation of the sound reproduction data by the sound reproduction control circuit in cases in which the counter circuit has overflowed prior to the count operation of the counter circuit stopping.

6. A sound reproduction system comprising:

the sound reproduction device of claim 1; and the control device, the control device including a second communication interface circuit configured to perform communication with the first communication interface circuit.

7. A sound reproduction device comprising:

a first communication interface circuit configured to perform communication with a control device;

a memory; and a processor connected to the memory, the processor configured to perform a required computation on audio source data so as to generate sound reproduction data to send to a speaker, control a count operation using a control signal received from the control device through the first communication interface circuit, and output a state of the count operation, and stop generation of the sound reproduction data based on the state of the count operation, wherein the control signal includes a start signal for starting the count operation, and a reset signal for resetting the count operation subsequent to the start signal, and in cases in which the state of the count operation is an overflow occurring as a result of the reset signal not having been received, the generation of the sound reproduction data is stopped.

8. The sound reproduction device of claim 7, wherein the control device includes a second communication interface circuit configured to perform communication with the first communication interface circuit, and the overflow occurs in cases in which the reset signal cannot be received due to a communication abnormality between the first communication interface circuit and the second communication interface circuit.

9. The sound reproduction device of claim 7, wherein the generation of the sound reproduction data is stopped in cases in which overflow has occurred prior to the count operation stopping.

* * * * *